US006945748B2

(12) United States Patent
Svihla et al.

(10) Patent No.: US 6,945,748 B2
(45) Date of Patent: Sep. 20, 2005

(54) CENTRIFUGAL COMPRESSOR WITH CHANNEL RING DEFINED INLET RECIRCULATION CHANNEL

(75) Inventors: Gary R. Svihla, Chicago, IL (US); Xinwen Xiao, Darien, IL (US); John M. Carr, Chicago, IL (US)

(73) Assignee: Electro-Motive Diesel, Inc., La Grange, IL (US)

( * ) Notice: Subject to any disclaimer, the term of this patent is extended or adjusted under 35 U.S.C. 154(b) by 63 days.

(21) Appl. No.: 10/762,397

(22) Filed: Jan. 22, 2004

(65) Prior Publication Data

US 2005/0163606 A1 Jul. 28, 2005

(51) Int. Cl.[7] ..... F01D 25/24
(52) U.S. Cl. ..... 415/58.4; 415/206
(58) Field of Search ..... 415/58.4, 58.6, 415/205, 206

(56) References Cited

U.S. PATENT DOCUMENTS 4,248,566 A 2/1981 Chapman et al. ..... 415/26
4,743,161 A 5/1988 Fisher et al. ..... 415/53 R
5,863,178 A * 1/1999 Scheinert et al. ..... 415/58.4
6,623,239 B2 * 9/2003 Sahay et al. ..... 415/119
6,726,441 B2 * 4/2004 Sumser et al. ..... 415/56.5

* cited by examiner

*Primary Examiner*—Ninh H. Nguyen
(74) *Attorney, Agent, or Firm*—Cook, Alex, McFarron, Manzo, Cummings & Mehler, Ltd.

(57) ABSTRACT

A centrifugal compressor includes an annular inlet air recirculation channel having a smoothly variable cross section extending from a first slot at a forward end of the channel adjacent an inlet member to a second slot at a rearward end of the channel beyond an inlet end of a vaned compressor impeller. The channel is formed between an aerodynamic channel ring supported in a smooth annular recess formed in a compressor housing and the separate inlet member. The ring may be mounted by radial struts connected with the housing and located in an area of low momentum air flow. The channel ring and the channel recess may be machined or otherwise formed with smoothly variable surfaces prior to assembly of the ring into the housing. The channel may have a smoothly diminishing annular cross section for aerodynamically efficient air flow.

9 Claims, 2 Drawing Sheets

CENTRIFUGAL COMPRESSOR WITH CHANNEL RING DEFINED INLET RECIRCULATION CHANNEL

TECHNICAL FIELD

This invention relates to centrifugal compressors and to a channel ring defined inlet recirculation channel for such compressors.

BACKGROUND OF THE INVENTION

It is known in the art relating to centrifugal compressors for air and other compressible gases that the operational range of pressure ratios of the compressor may be increased by providing bleed passages in the housing at suitable locations adjacent the impeller. This is particularly useful for engine turbocharger compressors, which are intended to operate over a wide range of rotational speeds under various conditions of engine speed, load and ambient pressure.

In particular cases, air inlet recirculation has been proposed; however, the recirculation passages and the inlet and outlet slots have varied in cross-sectional area and smoothness and have not been designed for flow efficiency.

SUMMARY OF THE INVENTION

The present invention provides an integrated turbocharger inlet design that allows optimizing aerodynamic performance of a centrifugal compressor utilizing inlet air recirculation. Configuring the inlet components in an aerodynamic fixed configuration minimizes losses associated with prior designs of fixed geometry and costs associated with more complicated designs of variable geometry.

The invention provides efficient compressor inlet air recirculation with a simple fixed channel system. In a preferred embodiment, three components, a compressor housing, an inlet member and a channel ring are interrelated to optimize the location, size and shape of a channel that joins a circumferential slot adjacent to the impeller with a circumferential opening preceding the impeller.

Use of the separate channel ring allows all surfaces of the channel to be accurately configured, by machining if required, to obtain an efficient flow channel configuration. Radial supports connecting the ring to the housing and inlet member are located near the channel inlet in an area of relatively low momentum air flow to prevent aerodynamic disturbances from adversely affecting the impeller during rotation at high speeds.

These and other features and advantages of the invention will be more fully understood from the following description of certain specific embodiments of the invention taken together with the accompanying drawings.

DESCRIPTION OF THE PREFERRED EMBODIMENT

Figure 1:
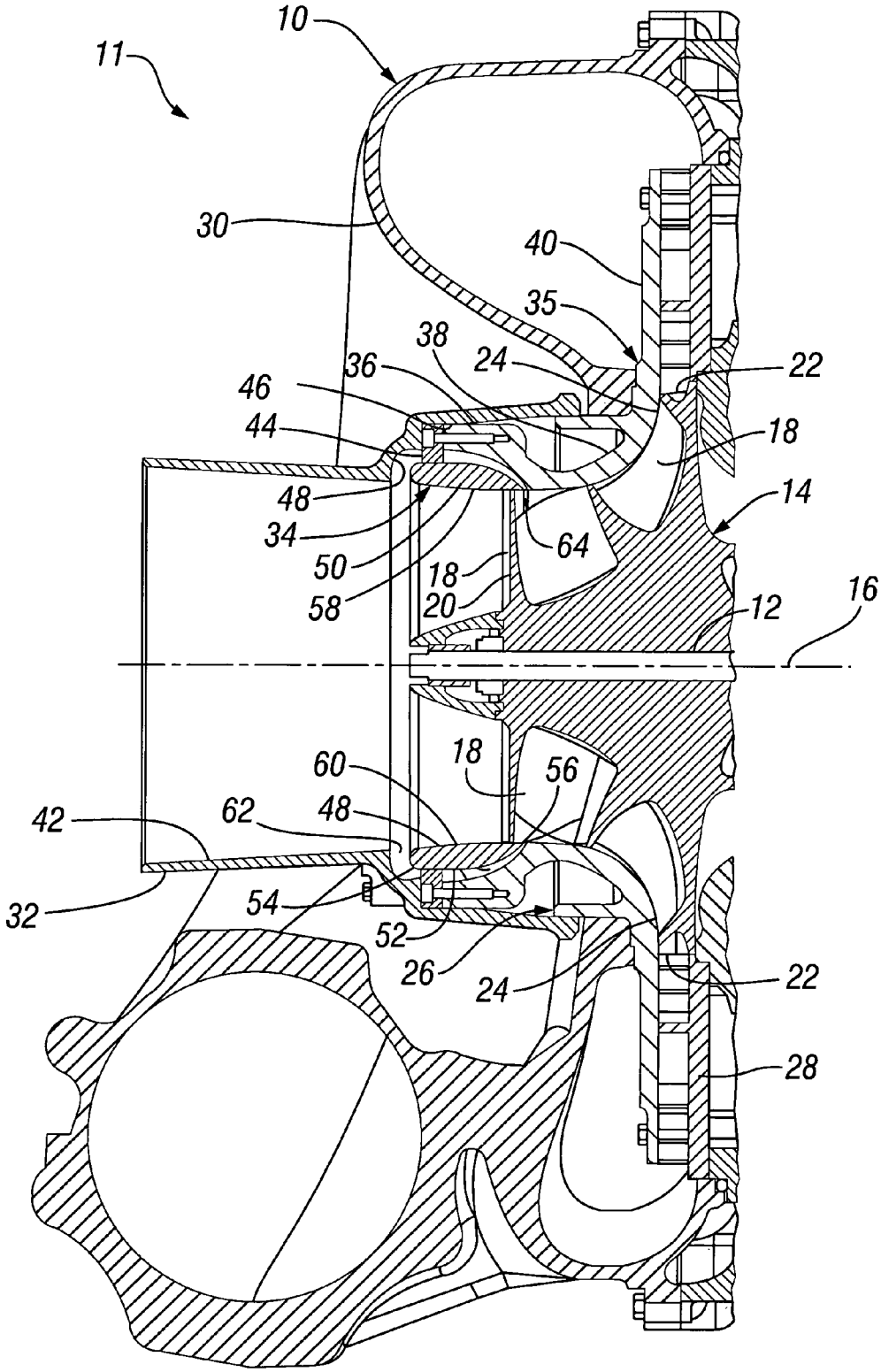
FIG. 1 is a cross-sectional view of the compressor end of an engine turbocharger having a recirculation channel in accordance with the invention.
Figure 2:
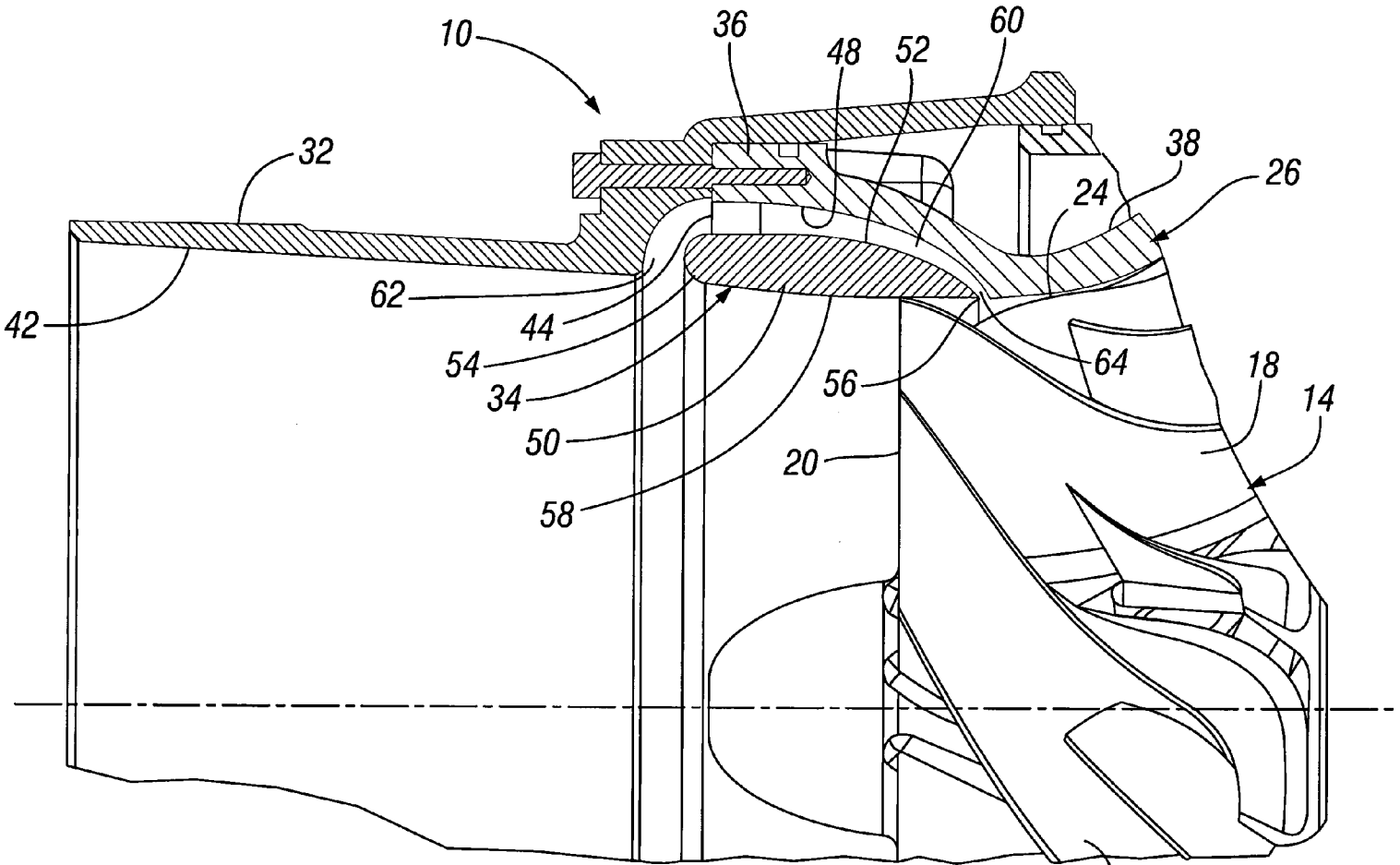
FIG. 2 is an enlarged cross-sectional view of the recirculation channel portion of the embodiment of FIG. 1.

Referring now to the drawings in detail, numeral 10 generally indicates a centrifugal compressor forming a portion of an engine turbocharger 11. The turbocharger includes an exhaust driven turbine, not shown, connected with a drive shaft 12 for rotatably driving an impeller 14 of the compressor. However, the features of the invention could also apply to other centrifugal compressors whether or not connected with engines or turbochargers.

The turbine, drive shaft and impeller are fixed together for rotation on a longitudinal axis 16. The impeller 14 includes a plurality of vanes 18, each having a leading edge 20, a trailing edge 22 and an outer edge 24. The compressor 10 further includes a compressor housing 26, a diffuser 28, an outlet scroll 30, an inlet member 32 and a channel ring 34.

The compressor housing includes an annular wall 35 having an inlet portion 36, an intermediate portion 38, and an outlet portion 40 that forms a front wall for the diffuser. The outlet scroll 30 mounts around the diffuser 28 and the outlet portion 40 of the annular wall 35 to receive pressurized gas, such as air, from the diffuser 28. The intermediate portion 38 extends for most of the length of and closely proximate to the outer edges 24 of the vanes 18.

The inlet member 32 is fixed to the inlet portion 36 of the housing wall and forms an inlet passage 42 of cylindrical or slightly frusto-conical configuration. The channel ring 34 has radial lugs or struts 44 that are fixed in slots 46 of the housing wall inlet portion 36. Alternatively, other forms of attachment, such as pins, could be utilized.

Surrounding the channel ring 34, the inner end of the inlet member 32 and the adjoining inlet end of the inlet portion 36 form an outwardly curved annular recess 48 in which an annular body 50 of the channel ring 34 is received. The body 50 of the channel ring 34 has an aerodynamic configuration which, in cross section of the illustrated embodiment, resembles an airfoil.

An outer surface 52 of the ring 34 is curved in a manner similar to an upper surface of an aircraft wing having, for example, a rounded leading edge 54 connected with the outer surface 52 curving inward to a relatively sharp trailing edge 56 of the ring 34. A connecting inner surface 58 extends linearly in a straight or slightly curved fashion from the inside of the rounded leading edge 54 to the sharp trailing edge 56. The ring inner surface 58 extends longitudinally in relatively close alignment with the inlet passage 42 of the inlet member 32 and the interior of the intermediate portion 38 of the housing wall.

The outer surface 52 of the channel ring is spaced inwardly from an opposing inner surface of the outwardly curved annular recess 48 to define an annular recirculation channel 60. The channel 60 is configured with a smoothly diminishing annular cross section from a first slot 62, at a forward end of the channel adjacent the inlet member, to a second slot 64 at a rearward end of the channel slightly beyond the inlet end of the impeller as defined by the leading edges 20 of the impeller vanes 18.

The thickness and longitudinal extent of the recirculation channel may be varied to obtain the desired amount and direction of recirculation air flow during operation of the compressor from the stall condition to the surge line of the pressure ratio map. The smaller cross section of the channel at the rearward second slot 64 allows flow into the impeller periphery to merge smoothly with the through flowing air stream. The larger cross section at the forward first slot 62 moderates air flow at this location to minimize the effect of reverse flow turbulence on the impeller blades leading edges. The radial support struts 44 are located in a zone of low momentum air flow near the opening of the first slot to minimize their effect upon the air flow in either forward or reverse directions.

In operation of the compressor with low mass air flow, air enters the inlet member 32 and is directed into the impeller 14, passing the leading edges 20 of at least some of the vanes 18. Then inlet pressure differentials cause some of the air flow along the inner surface 58 of the channel ring to enter the second slot 64 and recirculate through the channel 60 and first slot 62 into the main inlet air stream upstream of the impeller.

As the impeller speed increases, the recirculation flow decreases until the pressure differentials are reversed at higher mass flows. Then, some of the inlet air flow enters the first slot 62, passes through the channel 60 to the second slot 64 and reenters the main air stream, passing through the impeller vanes 18 and supplementing the air flow through the impeller.

The compressor air inlet system described provides both the functions of recirculating inlet air at low mass flows to move the surge line and increase operating range and bypassing inlet air at higher mass flows to increase the air flow passing through the impeller and being discharged from the compressor.

Use of the separate channel ring 34 allows the surfaces defining the recirculation channel 60, as well as the inner surface 58 of the channel ring, to be fully machined or otherwise formed, prior to assembly, with smooth low friction surfaces and with close tolerances to minimize aerodynamic losses of the air flow in the channel. Mounting of the inlet member 32 and the channel ring radial struts, both, directly to the compressor housing also minimizes tolerance stack up, and positioning of the struts minimizes flow disturbances at the channel outlet slots. A minimum number of struts, such as four, is preferred for minimal flow interference. These features all contribute to the efficiency of the low loss channel design, the configuration of which may be varied as needed to match various compressor configurations.

In summary, the invention emphasizes the following features:

- a compact, fixed geometry;
- a simple, cost-effective construction including profiled recirculation channel surfaces and slot openings;
- slots easily modified for differing impeller geometries;
- inner channel geometry minimizing fluid momentum loss to increase compressor efficiency; and
- minimal channel obstructions away from the rear impeller slot 64 to prevent aero-mechanical excitation of the impeller at higher air flows.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A centrifugal compressor comprising:

a centrifugal impeller rotatable on an axis and having impeller vanes extending from an inlet end for fluid entry into the impeller;

a compressor housing surrounding the impeller and defining therewith an annular fluid flow passage, the housing having an inlet protruding beyond the impeller inlet and configured for generally axial inlet flow and an outlet configured for generally radial outlet flow;

an inlet member attached to the housing inlet and forming an extension configured for generally axial inlet flow into the housing; and a separate channel ring fixed within the housing inlet and forming therewith an annular recirculation channel extending from the inlet member to beyond the impeller inlet end, the channel formed with a smoothly diminishing annular cross section from a first slot at a forward end of the channel adjacent the inlet member to a second slot at a rearward end of the channel beyond the impeller inlet end.

2. A centrifugal compressor as in claim 1 wherein the channel ring is supported in the housing by spaced radial connectors extending across the channel.

3. A centrifugal compressor as in claim 2 wherein the connectors are radial struts carried by the channel ring and extending into slots of the housing inlet.

4. A centrifugal compressor as in claim 2 wherein the connectors are positioned axially near a forward end of the channel ring.

5. A centrifugal compressor as in claim 1 wherein the channel ring has an aerodynamic cross section.

6. A centrifugal compressor as in claim 1 wherein the forward end of the impeller is positioned closer to the second slot than to the first slot.

7. A centrifugal compressor comprising:

a centrifugal impeller rotatable on an axis and having impeller vanes extending from an inlet end for fluid entry into the impeller;

a compressor housing surrounding the impeller and defining therewith an annular fluid flow passage, the housing having an inlet protruding beyond the impeller inlet and configured for generally axial inlet flow;

an inlet member attached to the housing inlet and forming an extension configured for generally axial inlet flow into the housing; and a separate channel ring fixed within the housing inlet and forming therewith an annular recirculation channel extending from the inlet member to beyond the impeller inlet end, the channel formed with a smoothly varying annular cross section from a first slot at a forward end of the channel adjacent the inlet member to a second slot at a rearward end of the channel beyond the impeller inlet end.

8. A centrifugal compressor as in claim 7 wherein the channel ring has an aerodynamic cross section.

9. A centrifugal compressor as in claim 7 wherein the channel ring is supported in the housing by spaced radial connectors extending across the channel.

* * * * *